US007713095B2

(12) United States Patent
Yodogawa

(10) Patent No.: US 7,713,095 B2
(45) Date of Patent: May 11, 2010

(54) CONTACT

(75) Inventor: Akihiro Yodogawa, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 12/428,109

(22) Filed: Apr. 22, 2009

(65) Prior Publication Data

US 2009/0269990 A1 Oct. 29, 2009

(30) Foreign Application Priority Data

Apr. 23, 2008 (JP) ..... P. 2008-112497

(51) Int. Cl.
*H01R 13/24* (2006.01)

(52) U.S. Cl. ..... 439/700

(58) Field of Classification Search ..... 439/700
See application file for complete search history.

(56) References Cited

U.S. PATENT DOCUMENTS 7,306,479 B1 * 12/2007 Wu ..... 439/497
7,435,109 B1 * 10/2008 Sugiura ..... 439/83
7,559,769 B2 * 7/2009 Hsiao et al. ..... 439/66

FOREIGN PATENT DOCUMENTS

JP 2000-195600 7/2000

* cited by examiner

*Primary Examiner*—Truc T Nguyen
(74) *Attorney, Agent, or Firm*—Morgan, Lewis & Bockius LLP

(57) ABSTRACT

A contact includes: an insulating housing, including a first face and a second face opposite to the first face, and formed with an insertion hole parallel to the first face and the second face, the first face formed with a first slit extending in an axial direction of the insertion hole, the insertion hole opening through the first slit; an electrically conductive case, formed with a second slit extending in the axial direction, and inserted into the insertion hole, the second slit facing the second face, a part of the case projected from the first face through the first slit; an electrically conductive plunger, disposed in the case, and having a distal end portion projected from the case; and a spring coil, disposed in the case, and urging the plunger in the axial direction.

8 Claims, 6 Drawing Sheets

CONTACT

BACKGROUND OF THE INVENTION

The present invention relates to a contact in which a spring connector is disposed substantially in parallel with a circuit board.

Referring to FIGS. 11A to 12, an example of a related-art contact in which a spring connector is disposed substantially in parallel with a circuit board will be briefly described. FIGS. 11A, 11B and 11C show an outer appearance of the related-art contact, in which FIG. 11A is a front view, FIG. 11B is a bottom view, and FIG. 11C is a side view. FIG. 12 is an enlarged sectional view taken along a line A-A in FIG. 11B, in which an internal structure of an electrically conductive metal tube is omitted. In FIGS. 11A to 12, each of spring connectors 10 includes a conductive metal tube 12 which is open at one end and closed at the other end, a spring coil (not shown) which is inserted into the conductive metal tube 12 from the open end side, and a plunger 14 formed of conductive metal which is additionally inserted into the conductive metal tube 12. The open end of the conductive metal tube 12 is narrowed so that the plunger 14 can move in an axial direction having its distal end portion projected outward from the open end, but may not escape. Moreover, an insulating housing 16 formed of insulating resin or the like substantially in a shape of a box is provided with bottomed insertion holes 16*a* which are in parallel with a bottom face thereof and open at a side of the bottom face in a shape of slit in the axial direction. The spring connectors 10 are respectively inserted into these insertion holes 16*a*, and portions of outer peripheral faces of the respective conductive metal tubes 12 are slightly protruded from the openings on the bottom face of the insulating housing 16, whereby the contact is constructed. The contact having the above described structure is mounted on the circuit board, and the portions of the outer peripheral faces of the conductive metal tubes 12 which are protruded from the bottom face of the insulating housing 16 are soldered to connecting terminals of the circuit board by solder reflowing or the like, whereby electrical connection is established. An art similar to the related art having such structure is disclosed in JP-A-2000-195600.

In the structure of the related-art contact as described above, as shown in FIG. 12, a height H of the contact from a soldered face of the circuit board is a sum of an outer diameter D of the conductive metal tube 12 and a thickness T of the insulating housing 16 at a position where it covers this conductive metal tube 12. Recently, a mobile phone or the like becomes more and more compact and thin, and therefore, it is keenly desired that the contact is also made thinner. However, in order to reduce the outer diameter D of the conductive metal tube 12, it is required that the spring coil and the plunger 14 incorporated therein are made compact. This is technically difficult, and makes production difficult. Besides, by reducing the thickness T of the insulating housing 16 at the position covering the conductive metal tube 12, mechanical strength of the insulating housing 16 would be weakened, and this has a limit in itself. It is to be noted that the contact having the above described structure is used, as an example, for electrical connection of battery packs in electronic appliances and so on.

SUMMARY

It is therefore an object of the invention to provide a contact in which a spring connector is arranged substantially in parallel with a circuit board, and a height of the contact from a soldered face of the circuit board can be reduced.

In order to achieve the object, according to the invention, there is provided a contact comprising:

an insulating housing, including a first face and a second face opposite to the first face, and formed with an insertion hole parallel to the first face and the second face, the first face formed with a first slit extending in an axial direction of the insertion hole, the insertion hole opening through the first slit;

an electrically conductive case, formed with a second slit extending in the axial direction, and inserted into the insertion hole, the second slit facing the second face, a part of the case projected from the first face through the first slit;

an electrically conductive plunger, disposed in the case, and having a distal end portion projected from the case; and a spring coil, disposed in the case, and urging the plunger in the axial direction.

The case may be formed with an engaging piece which can be elastically deformed, on a peripheral face. The insertion hole may be formed with an engaging recess which is to be engaged with the engaging piece.

The plunger may have a large diameter portion a diameter of which is larger than a diameter of the distal end portion. The plunger may be movable in the case in the axial direction. The case may be provided with a sliding contact portion which has elasticity in a radial direction of the case so as to be in elastically contact with the large diameter portion, within a range in which the large diameter portion moves in the axial direction.

The case may be formed with third slits which are substantially perpendicular to the axial direction, at both ends of the range in the axial direction.

The case may be formed with a cutout which is substantially parallel to the axial direction, between the third slits.

The sliding contact portion of the case may be formed with a convex rib which extends in the axial direction and which is in elastically contact with the large diameter portion.

The sliding contact portion of the case may be formed in a wave shape in section.

The insertion hole may be formed with a projecting portion projected toward the first face and being fitted to the second slit.

BRIEF DESCRIPTION OF THE DRAWINGS

FIGS. 3A and 3B show a case formed of a conductive metal sheet, in which FIG. 3A is a perspective view showing its outer appearance, and FIG. 3B is an enlarged sectional view taken along a line B-B in FIG. 3A.

FIGS. 11A, 11B and 11C show an outer appearance of a related-art contact, in which FIG. 11A is a front view, FIG. 11B is a bottom view, and FIG. 11C is a side view.

DETAILED DESCRIPTION OF PREFERRED EMBODIMENTS

Figure 1:
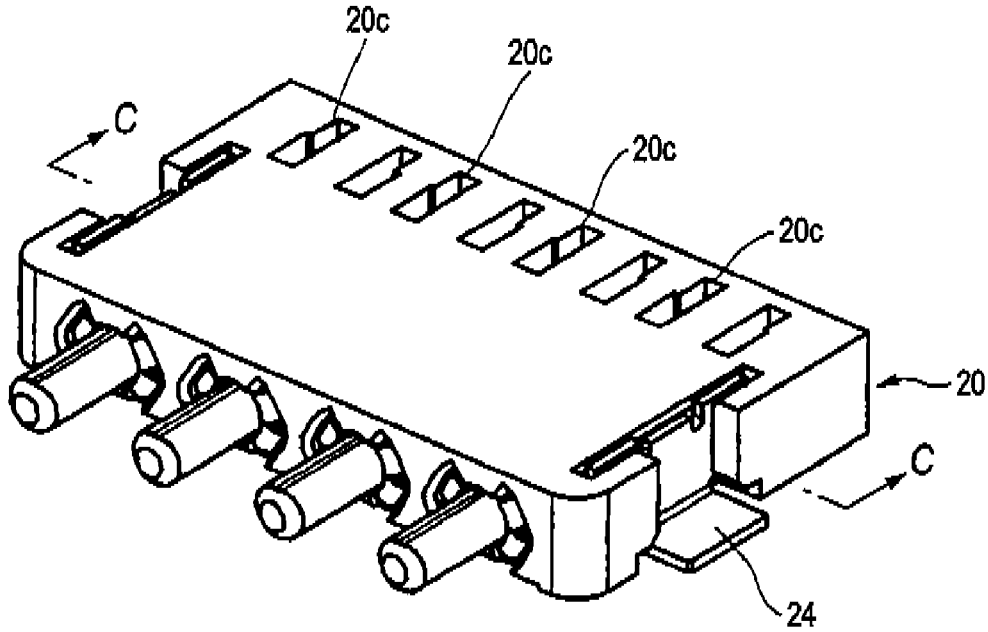
FIG. 1 is a perspective view showing an outer appearance of a contact in a first embodiment of the invention.
Figure 2:
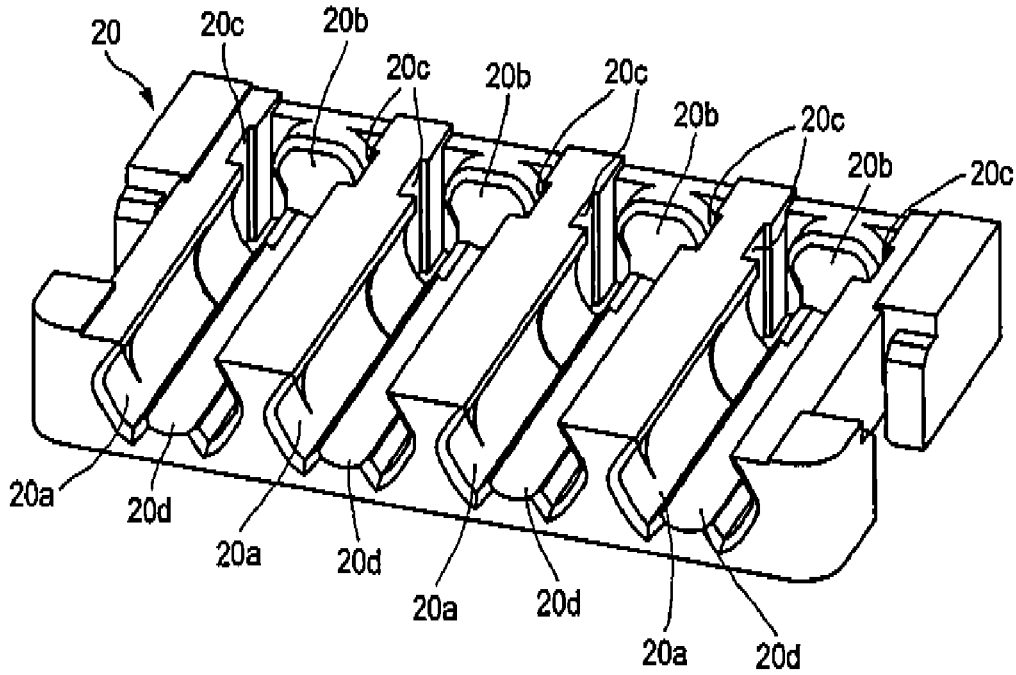
FIG. 2 is a perspective view showing an outer appearance of an insulating housing as seen from a bottom face side.

Now, a first embodiment of the invention will be described referring to FIGS. 1 to 6.

In FIGS. 1 to 6, an insulating housing 20 formed of insulating resin or the like substantially in a shape of box is provided with a plurality of bottomed insertion holes 20*a* which are parallel to a bottom face, and open in a slit-like shape in an axial direction at the bottom face side, in parallel with one another, in the same manner as in the related art. These insertion holes 20*a* are provided, in respective bottom portions thereof, with abutting recesses 20*b*. One ends of spring coils 22 are abutted against the abutting recesses 20*b* thereby to restrict movements of the spring coils 22 in a direction perpendicular to the axial direction. Moreover, engaging recesses 20*c* are formed on peripheral faces of the insertion holes 20*a* at the bottom side thereof. Further, rail portions 20*d* in a shape of rib which extend in the axial direction from the opening sides to the bottom side of the insertion holes 20*a* and project into inside of the insertion holes 20*a* are respectively provided on the peripheral faces of the insertion holes 20*a* opposed to the slit-like openings. In each of the rail portions 20*d*, a distal end face of the rib has a diameter in section which is equal to or slightly larger than an outer diameter of the spring coil 22. In addition, solder reinforcing plates 24 for securing the insulating housing 20 by soldering to a surface of a circuit board 30 are provided at both ends of the insulating housing 20. A case 26 formed of a conductive metal sheet has such an outer shape that it can be inserted into the insertion hole 20*a*, and is longer in the axial direction. The case 26 is formed in a C-shape or a U-shape in section, and provided with a slit-like opening 26*a* which is longer in the axial direction. A width of the opening 26*a* of the case 26 is set to be a width such that the rail portion 20*d* of the insertion hole 20*a* can be inserted to be fitted thereto. This case 26 has such a shape that it can be inserted into the insertion hole 20*a* with the opening 26*a* directed upward, in such a manner that a part of its outer peripheral face at an opposite side to the opening 26*a* may be slightly protruded from the slit-like opening on the bottom face of the insulating housing 20. Moreover, the case 26 is provided with engaging pieces 26*b*, whereby the case 26 is elastically deformed easily, when it is inserted into the insertion hole 20*a*, thereby to reduce its outer diameter. When the case 26 has been inserted into the insertion hole 20*a*, the engaging pieces 26*b* are engaged with the engaging recesses 20*c* to be elastically restored, so that the case 26 may not escape in a direction opposite to an insertion direction. Further, on occasion of assembling, the spring coil 22 and a plunger 28 formed of conductive metal are inserted into the case 26. A narrowed portion 26*c* is formed inside the case 26 for preventing the plunger 28 from escaping from the case 26, and at the same time, for allowing a distal end portion 28*a* of the plunger 28 to be protruded outward. The plunger 28 having the distal end portion 28*a* which can pass the narrowed portion 26*c* and a large diameter portion 28*b* which cannot pass the narrowed portion 26*c* is movable in the axial direction. The case 26 is provided with a sliding contact portion 26*d* which has elasticity in a radial direction with respect to the axial direction so as to be elastically in contact with the large diameter portion 28*b* of the plunger 28 within a range in which the large diameter portion 28*b* moves in the axial direction. This sliding contact portion 26*d* is provided with slits 26*e* which are substantially perpendicular to the axial direction, at both ends of the range in which the large diameter portion 28*b* moves in the axial direction, except a part at an opposite side to the opening 26*a*, and so shaped as to have elasticity in the radial direction. An area enclosed by these slits 26*e* at the both ends is formed in a wave shape in section, as shown in FIG. 3B, and convex ribs 26*f* which are longer in the axial direction are formed on an inner face of the case 26. These convex ribs 26*f* are formed respectively between distal end portions and intermediate portions of the slits 26*e* in a circumferential direction, and also between base end portions and the intermediate portions, and adapted to be elastically in contact with the large diameter portion 28*b* of the plunger 28. In assembling the contact according to the invention, the spring coil 22 is inserted into the insertion hole 20*a* in the insulating housing 20, the plunger 28 is arranged, and then, the case 26 is inserted. After the case 26 has been inserted in the axial direction by a determined amount, the engaging pieces 26*b* are engaged with the engaging recesses 20*c* whereby an escape of the case 26 is prevented. In this state, the spring coil 22 is contracted so as to urge the plunger 28 with a determined elasticity. In a state where the spring coil 22, the plunger 28 and the case 26 are incorporated into the insulating housing 20, the spring connector which has the same function as the one employing the related-art conductive metal tube 12 is constructed by means of the spring coil 22, the plunger 28, the case 26, and the rail portion 20*d*.

Figure 5:
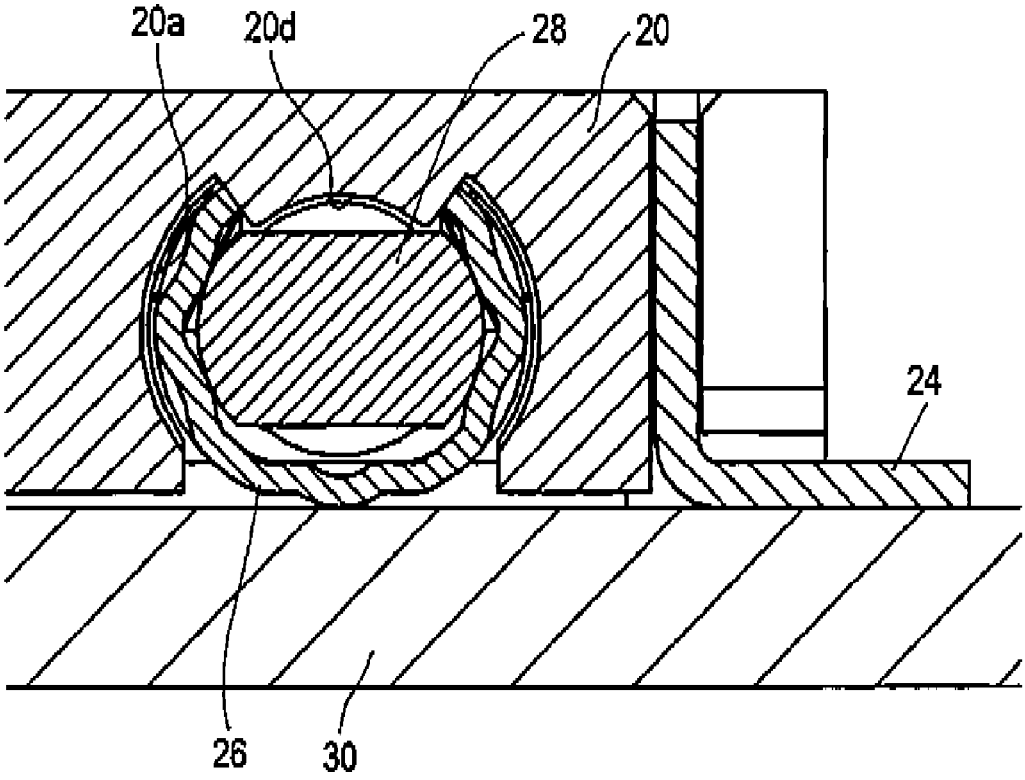
FIG. 5 is an enlarged sectional view taken along a line C-C in FIG. 1.
Figure 6:
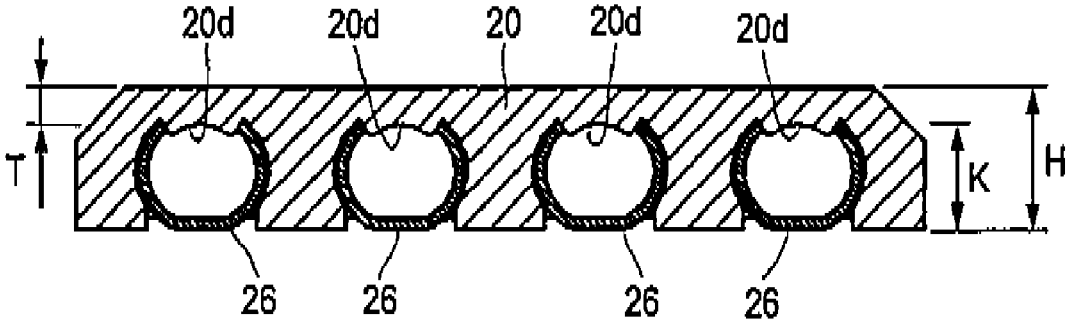
FIG. 6 is a sectional view of FIG. 1, in which an internal structure of the case is omitted.
Figure 11A:
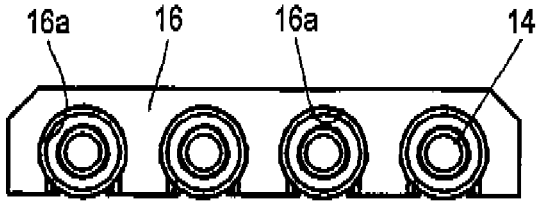
Figure 11B:
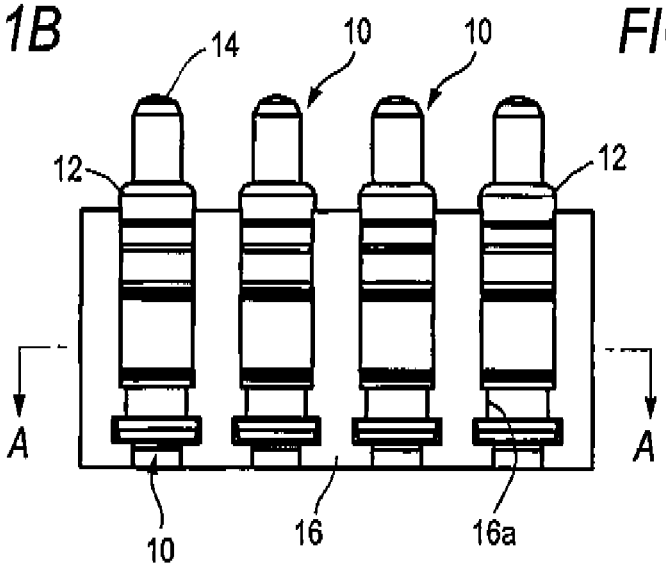
Figure 11C:
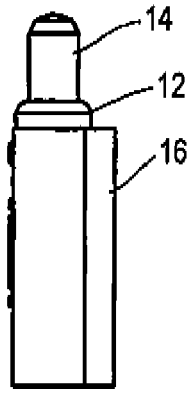
Figure 12:
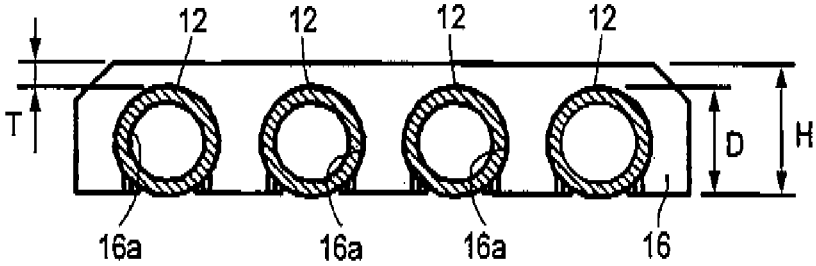
FIG. 12 is an enlarged sectional view taken along a line A-A in FIG. 11B, in which an internal structure of a conductive metal tube is omitted.

In the contact according to the invention having the above described structure, the one part of the outer peripheral face of the case 26 which is slightly protruded from the opening on the bottom face of the insulating housing 20 is brought into contact with the circuit board 30, as shown in FIG. 5, and soldered to the circuit board 30 together with the solder reinforcing plate 24 by solder reflowing or the like. Because the case 26 having the C-shape or U-shape in section is used, as shown in FIG. 6, in place of the related-art conductive tube 12 which are shown in FIGS. 11A to 12, a height K of the case 26 from a soldered face of the circuit board 30 can be made smaller than in the related art in which the conductive metal tube 12 is used. Therefore, it is possible to make the height H of the contact according to the invention from the soldered face of the circuit board 30 smaller than in the related art, even though the thickness T of the insulating housing 20 in the portion covering the case 26 is the same. Moreover, because the case 26 is formed of sheet metal, its production cost can be reduced. Further, because the large diameter portion 28*b* of the plunger 28 is formed in an oval shape in section, as shown in FIG. 5, and a part of the insulating housing 20 is protruded into the case 26 though slightly, a space inside the case 26 is made non-circular in section, having a substantially D-shape or so. In this manner, the plunger 28 is restrained from rotating around its axis. Still further, because the convex ribs 26*f* provided in the sliding contact portion 26*d* is in elastically contact with the large diameter portion 28*b*, electrical conductivity of the sliding contact portion 26*b* can be reliably obtained.

Figure 7:
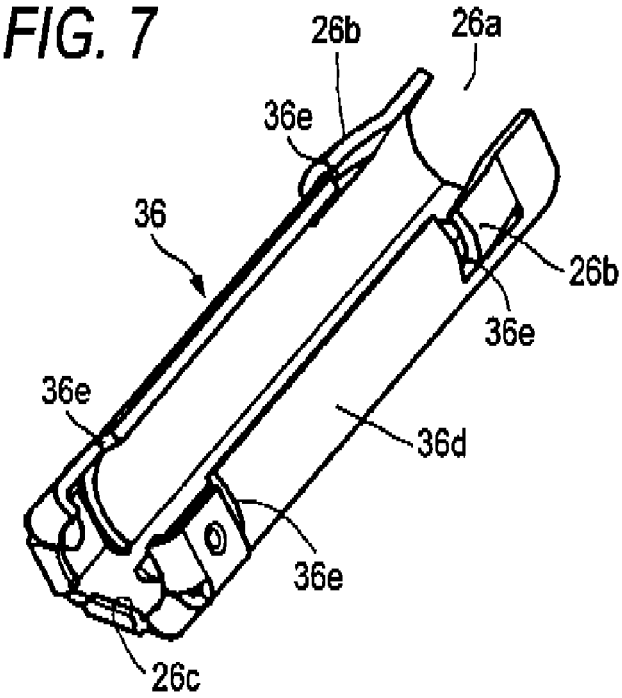
FIG. 7 is a perspective view showing an outer appearance of a case which is used in a second embodiment of the invention.

Then, referring to FIG. 7, a case which is used in a second embodiment of the invention will be described. In FIG. 7, members and structures which are equal or equivalent to the case used in the first embodiment as shown in FIGS. 3A and 3B are denoted with the same reference numerals, and overlapped descriptions will be omitted.

Figure 3A:
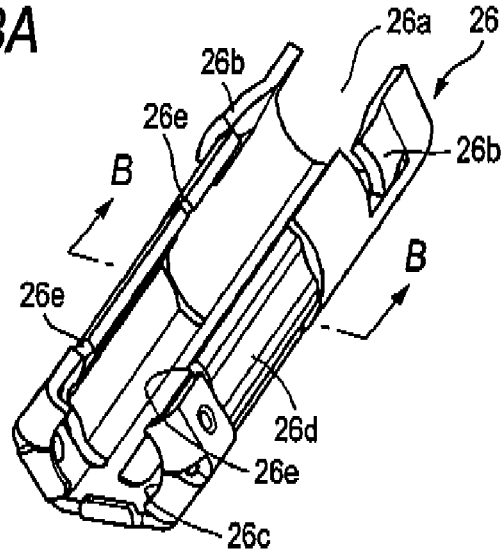
Figure 3B:
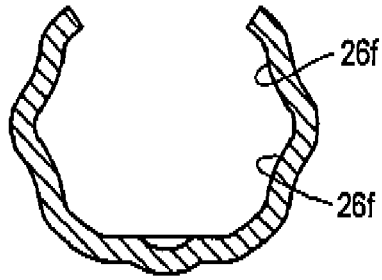
Figure 4:
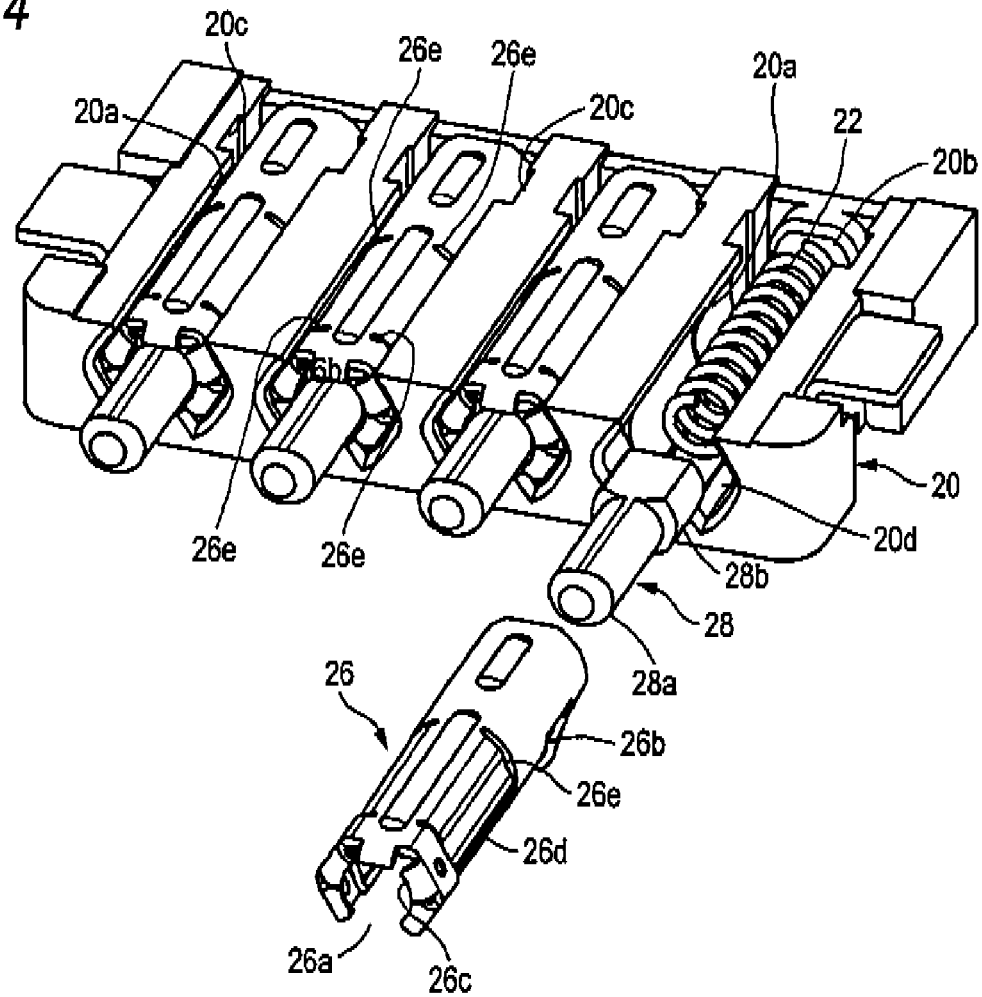
FIG. 4 is a perspective view showing the outer appearance of the contact in the first embodiment of the invention, as seen from the bottom face side, for explaining its assembly.

A remarkable difference between a case 36 formed of a conductive metal sheet which is used in the second embodiment as shown in FIG. 7 and the case 26 which is used in the first embodiment as shown in FIGS. 3A and 3B lies in positions of slits 36*e* defining a sliding contact portion 36*d*. In the case 36 as shown in FIG. 7, the slits 36*e* are provided at a forward side of the range in which the large diameter portion 28*b* of the plunger 28 moves, and the other slits 36*e* which are commonly used for forming the engaging pieces 26*b* are provided at a backward side, whereby the sliding contact portion 36*d* is defined. Although the convex ribs 26*f* which are provided in the first embodiment are not provided on this sliding contact portion 36*d*, it is also possible to provide them.

Figure 8:
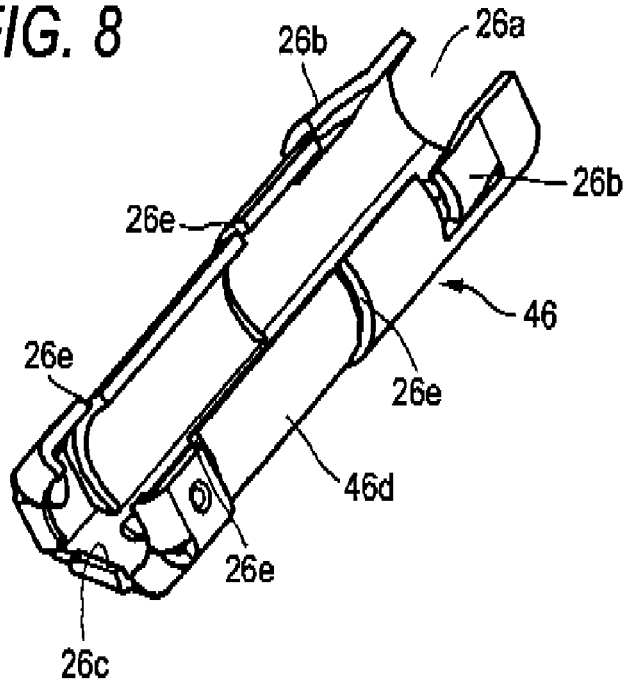
FIG. 8 is a perspective view showing an outer appearance of a case which is used in a third embodiment of the invention.

Further, referring to FIG. 8, a case which is used in a third embodiment of the invention will be described. In FIG. 8, members and structures which are equal or equivalent to the case used in the first embodiment as shown in FIGS. 3A and 3B are denoted with the same reference numerals, and overlapped descriptions will be omitted.

A case 46 formed of a conductive metal sheet which is used in the third embodiment as shown in FIG. 8 is different from the case 26 which is used in the first embodiment as shown in FIGS. 3A and 3B in that the convex ribs 26*f* which are provided in the first embodiment are not provided on a sliding contact portion 46*d*.

Figure 9A:
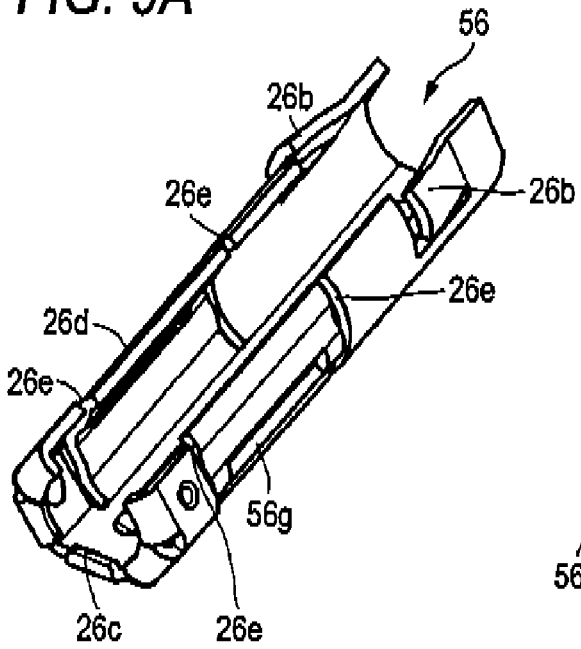
FIGS. 9A and 9B are views showing a case which is used in a fourth embodiment of the invention.
Figure 9B:
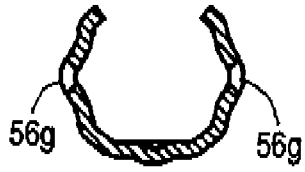

Further, referring to FIGS. 9A and 9B, a case which is used in a fourth embodiment of the invention will be described. In FIGS. 9A and 9B, members and structures which are equal or equivalent to the case used in the first embodiment as shown in FIGS. 3A and 3B are denoted with the same reference numerals, and overlapped descriptions will be omitted.

A case 56 formed of a conductive metal sheet which is used in the fourth embodiment as shown in FIGS. 9A and 9B is different from the case 26 which is used in the first embodiment as shown in FIGS. 3A and 3B in that cutouts 56*g* which are substantially parallel to the axial direction, and longer in the axial direction are formed at intermediate positions in the circumferential direction of the slits 26*e*, between the slits 26*e* defining the sliding contact portions 26*d* in the axial direction. By forming these cutouts 56*g*, a length of a portion connecting an idle end side and a base end side of the sliding contact portions 26*d* is made shorter. Accordingly, elastic deformation of the idle end side is easily achieved, and elasticity of the idle end side to be in elastically contact with the large diameter portion of the plunger 28 can be reduced. Therefore, sliding performance of the plunger 28 will not be deteriorated.

Figure 10A:
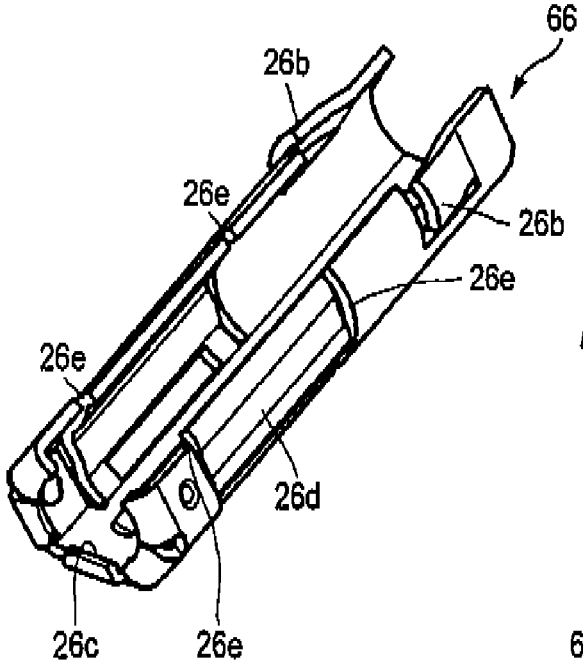
FIGS. 10A and 10B are views showing a case which is used in a fifth embodiment of the invention.
Figure 10B:
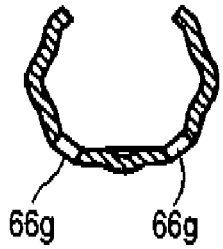

Further, referring to FIGS. 10A and 10B, a case which is used in a fifth embodiment of the invention will be described. In FIGS. 10A and 10B, members and structures which are equal or equivalent to the case used in the first embodiment as shown in FIGS. 3A and 3B and in the fourth embodiment as shown in FIGS. 9A and 9B are denoted with the same reference numerals, and overlapped descriptions will be omitted.

A case 66 formed of a conductive metal sheet which is used in the fifth embodiment as shown in FIGS. 10A and 10B is different from the case 26 which is used in the first embodiment as shown in FIGS. 3A and 3B in that cutouts 66*g* which are substantially parallel to the axial direction, and longer in the axial direction are formed at distal end side positions in the circumferential direction of the slits 26*e*, between the slits 26*e* defining the sliding contact portion 26*d* in the axial direction. By forming these cutouts 66*g* at the distal end side positions in the circumferential direction of the slits 26*e*, a length of portions connecting the sliding contact portions 26*d* to the case 26 at the base end side is made shorter. Accordingly, elastic deformation of the idle end side is easily achieved, and elasticity of the entire idle end side to be in elastically contact with the large diameter portion of the plunger 28 can be reduced. Therefore, sliding performance of the plunger 28 will not be deteriorated.

In the above described embodiments, the one ends of the spring coils 22 are abutted against the abutting recesses 20*b* which are provided in the bottom of the bottomed insertion holes 20*a* of the insulating housing 20. However, the invention is not limited to such structure, but each of the case 26 may be provided with a restraining portion against which the one end of the spring coil 22 is abutted. In such structure, the case 26 in which the plunger 28 and the spring coil 22 have been incorporated in advance may be inserted into the insertion hole 20*a* of the insulating housing 20. Therefore, the insertion hole 20*a* need not be necessarily a bottomed hole, provided that an insertion length of the case 26 into the insertion hole 20*a* can be restricted.

According to an aspect of the invention, the case formed of electrically conductive metal sheet and having a C-shape or a U-shape in section which is longer in the axial direction and has the opening in the axial direction is used in place of the related-art electrically conductive metal tube. Therefore, it is possible to reduce the height of the case, and accordingly, to reduce the height of the contact. Moreover, the case is formed of sheet metal, and can be easily manufactured at a lower cost than the tube.

According to an aspect of the invention, the engaging piece provided in the case is engaged with the engaging recess provided in the insertion hole. Therefore, the case which has been inserted into the insertion hole is prevented from escaping, and can be easily assembled.

According to an aspect of the invention, the case is provided with the sliding contact portion which is in elastically contact with the large diameter portion of the plunger. Therefore, electrical connection between the plunger and the case can be reliably established.

According to an aspect of the invention, the slits which are substantially perpendicular to the axial direction are provided in the case at both ends of the range in which the large diameter portion of the plunger moves, and therefore, the sliding contact portion which is in elastically contact with the large diameter portion can be easily formed in the case.

According to an aspect of the invention, the cutouts which are long and substantially parallel to the axial direction are provided between the slits defining the sliding contact portion. Therefore, a part of the sliding contact portion continued to the case becomes shorter in length accordingly, and becomes liable to be elastically deformed easily. In this manner, it is possible to reduce elasticity of the sliding contact portion when it is in elastically contact with the large diameter portion of the plunger.

According to an aspect of the invention, the convex rib in the axial direction is formed in the sliding contact portion. Therefore, a distal end portion of this convex rib is abutted against the large diameter portion of the plunger, and reliable electrical connection can be obtained.

According to an aspect of the invention, it is possible to easily form the convex rib in the axial direction in the sliding contact portion, by forming the sliding contact portion in a wave shape in section.

What is claimed is:

1. A contact comprising:

an insulating housing, including a first face and a second face opposite to the first face, and formed with an insertion hole parallel to the first face and the second face, the first face formed with a first slit extending in an axial direction of the insertion hole, the insertion hole opening through the first slit;

an electrically conductive case, formed with a second slit extending in the axial direction, and inserted into the insertion hole, the second slit facing the second face, a part of the case projected from the first face through the first slit;

an electrically conductive plunger, disposed in the case, and having a distal end portion projected from the case; and a spring coil, disposed in the case, and urging the plunger in the axial direction.

2. The contact according to claim 1, wherein the case is formed with an engaging piece which can be elastically deformed, on a peripheral face, and the insertion hole is formed with an engaging recess which is to be engaged with the engaging piece.

3. The contact according to claim 1, wherein the plunger has a large diameter portion a diameter of which is larger than a diameter of the distal end portion, the plunger is movable in the case in the axial direction, and the case is provided with a sliding contact portion which has elasticity in a radial direction of the case so as to be in elastically contact with the large diameter portion, within a range in which the large diameter portion moves in the axial direction.

4. The contact according to claim 3, wherein the case is formed with third slits which are substantially perpendicular to the axial direction, at both ends of the range in the axial direction.

5. The contact according to claim 4, wherein the case is formed with a cutout which is substantially parallel to the axial direction, between the third slits.

6. The contact according to claim 3, wherein the sliding contact portion of the case is formed with a convex rib which extends in the axial direction and which is in elastically contact with the large diameter portion.

7. The contact according to claim 6, wherein the sliding contact portion of the case is formed in a wave shape in section.

8. The contact according to claim 1, wherein the insertion hole is formed with a projecting portion projected toward the first face and being fitted to the second slit.

* * * * *